US005311800A

United States Patent [19]

Focke et al.

[11] Patent Number: 5,311,800

[45] Date of Patent: May 17, 1994

[54] APPARATUS FOR SEVERING (COLLAR) BLANKS FROM A WEB OF MATERIAL

[75] Inventors: Heinz Focke, Verdon; Frank Oberschelp, Hanover, both of Fed. Rep. of Germany

[73] Assignee: Focke & Co. (GmbH & Co.), Verden, Fed. Rep. of Germany

[21] Appl. No.: 883,771

[22] Filed: May 15, 1992

[30] Foreign Application Priority Data

May 17, 1991 [DE] Fed. Rep. of Germany ..... 4116141

[51] Int. Cl.[5] ..... B26D 1/40

[52] U.S. Cl. ..... 83/168; 83/344; 83/348

[58] Field of Search ..... 83/348, 168, 344, 347, 83/503, 506, 508.2; 72/203

[56] References Cited

U.S. PATENT DOCUMENTS

| | | | |
|---|---|---|---|
| 838,147 | 12/1906 | Sturgis | 83/344 |
| 3,257,885 | 6/1966 | Hornung | 83/348 X |
| 3,274,874 | 9/1966 | Treiber et al. | 83/348 |
| 4,341,525 | 7/1982 | Wittkopf | 83/344 X |
| 4,359,919 | 11/1982 | Fuch et al. | 83/349 |
| 4,574,817 | 3/1986 | Suzuki | 83/168 X |

FOREIGN PATENT DOCUMENTS

| | | |
|---|---|---|
| 2511341 | 11/1975 | Fed. Rep. of Germany . |
| 2602153 | 9/1976 | Fed. Rep. of Germany . |
| 3539223 | 3/1989 | Fed. Rep. of Germany . |
| 0589949 | 1/1978 | U.S.S.R. . |

*Primary Examiner*—Richard K. Seidel
*Assistant Examiner*—Kenneth E. Peterson
*Attorney, Agent, or Firm*—Sughrue, Mion, Zinn, Macpeak & Seas

[57] ABSTRACT

An apparatus for severing (collar) blanks from a web of material is disclosed. Knife rollers (10) which are provided with knife edges (17) are used to sever blanks of (thin) cardboard from a web. A knife roller (10) is pressed against a counter roller (11). For this purpose, there are provided resiliently adjustable pressure elements (30). The pressure is exerted on the counter roller (11) in the region of annular supporting elements, in particular annular rims (18). The annular rims (18) for exerting pressure are designed such that they are slightly resiliently compressible in the region of contact with the counter roller (11). For this purpose, the annular rims are especially designed to be Z-shaped in cross section.

9 Claims, 6 Drawing Sheets

APPARATUS FOR SEVERING (COLLAR) BLANKS FROM A WEB OF MATERIAL

BACKGROUND OF THE INVENTION

The invention relates to an apparatus for severing blanks, especially collar blanks of a hinge lid pack, from a web of material, which apparatus comprises severing knives (knife edges), which are arranged on a rotating knife roller, and a counter means, preferably a counter roller which also rotates, the knife roller resting against the web of material or the counter means with a resilient pressure resulting from spring means.

Packaging machines are often equipped with cutting or punching tools which produce the blanks which are processed in the packaging machine by way of severing the blanks from a web of material. The cutting tools are subjected to considerable wear and tear, especially if the blanks which are to be produced are made of thin cardboard and the packaging machine has a particularly high capacity.

Hinge lid packs for cigarettes etc. normally have a collar which is formed from a separate blank (U.S. Pat. No. 4,084,393). The collar is severed from a web of cardboard within the packaging machine (U.S. Pat. No. 4,938,005).

The cutting and severing tools employed for this purpose consist of a rotating knife roller. Cutting knives which are in the form of projecting knife edges are arranged on the shell surface of the knife roller in such a way that a they correspond to the contours of the (collar) blanks. A counter roller which also rotates and which has a smooth cylindrical shell surface serves as a counter pressure means. The web of material is conveyed through between knife roller and counter roller.

To apply precise severing cuts, it is important that the contact pressure of the knife roller and therewith the cutting pressure is adjusted as accurately as possible. This pressure must remain as accurate as possible even when the knife edges start to wear.

SUMMARY OF THE INVENTION

The invention is based on the object to develop and improve a cutting or severing unit of the above described type in such a way that, without impeding the capacity, the wear and tear is reduced and, consequently, the edge life of the cutting unit is increased.

To attain this object, the apparatus according to the invention is characterized in that spring means are adjustable as regards their spring tension and in that the knife roller contacts the counter means (counter roller) with lateral annular supporting rims (annular rim) which are slightly compressible in a resilient manner.

According to the invention, a precise adjustable resilient contact pressure is exerted on the knife roller or to axle journals of the knife roller. This contact pressure is transferred via lateral supporting means, in particular annular rims, to the counter part of the knife roller, i.e. to the counter roller which also has supporting rims. The annular rims of the knife roller are designed in such a way that there is a small resilient deformation in the region of contact with the counter roller 11. For this purpose, the annular rims of the knife roller are especially formed from a profile which ensures compressibility. A ring which has a Z-shaped cross section is particularly suitable for this purpose.

According to a further important feature of the invention, the knife roller is resiliently supported on the side which is located opposite the resilient pressure means, specifically on a biased pressure spring. The force of the spring tension of this counter pressure means is smaller than the force of the contact pressure of the pressure means.

According to the invention, the knife roller is mounted in a special way, particularly with a bearing ring in an upright oblong hole of lateral support means. This allows an adjusting movement of the knife roller, even though this roller is accurately mounted and guided.

An exemplary embodiment of the apparatus according to the invention will be described below in detail with reference to the drawings, in which:

DESCRIPTION OF A PREFERRED EMBODIMENT

Figure 1:
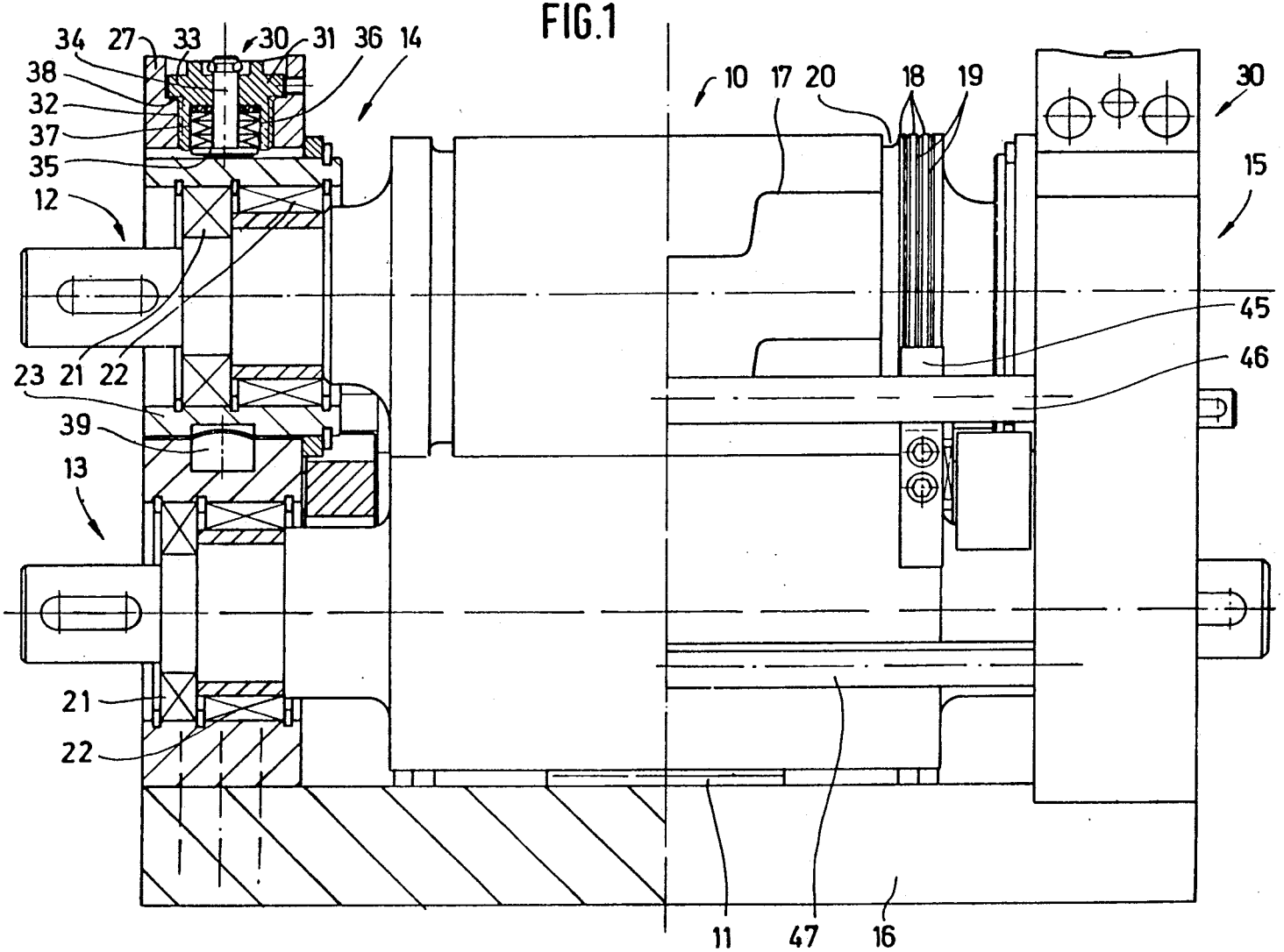
FIG. 1 is a cross-axial view, partly in vertical section, of an apparatus with a knife roller and counter roller.
Figure 2:
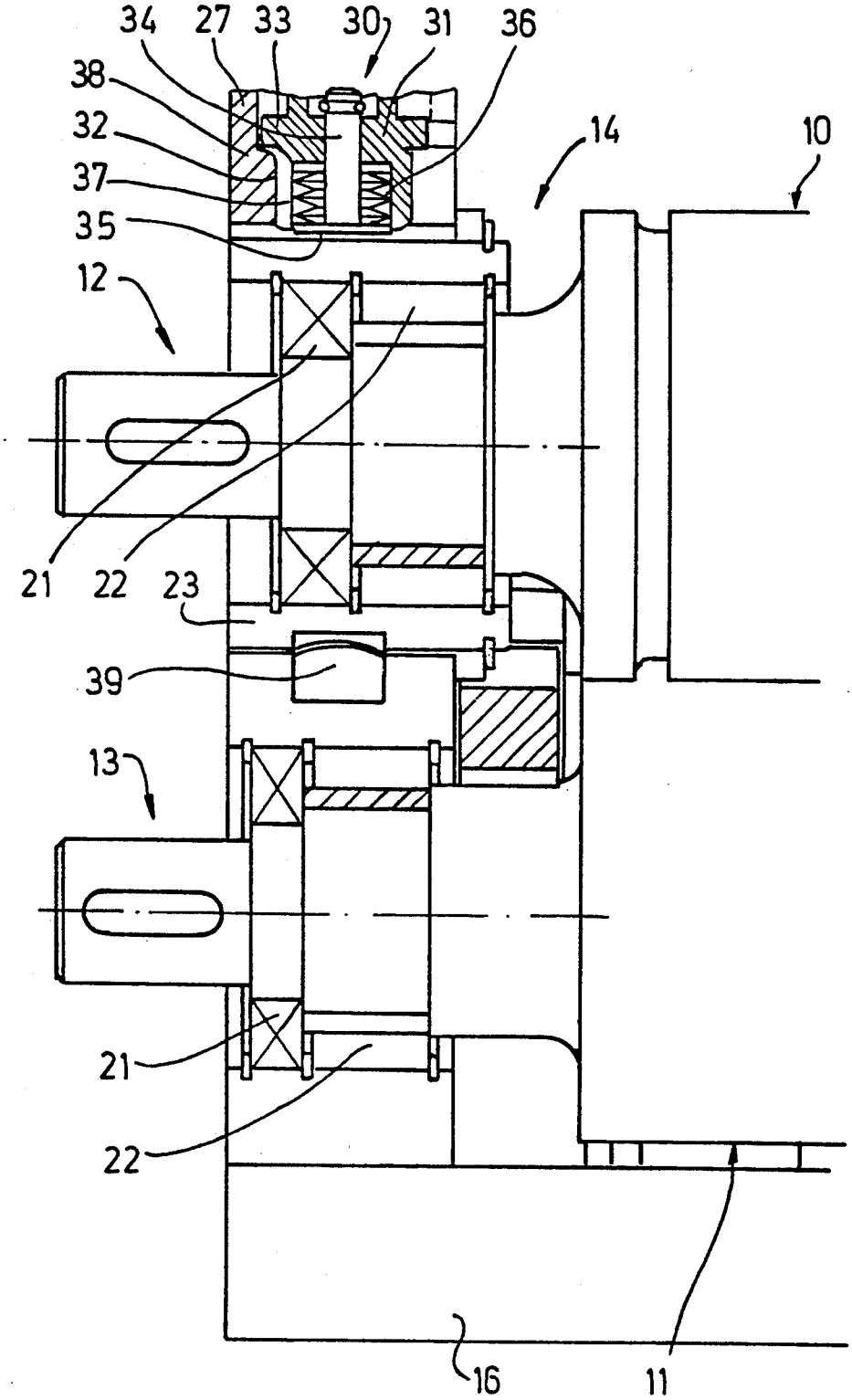
FIG. 2 shows a detail of FIG. 1 on an enlarged scale.

The exemplary embodiment which is illustrated in the drawings is designed for a continuous production of collar blanks as they are used in hinge lid packs. The blanks are severed from a continuously fed web of thin cardboard, as it is for example illustrated and described in U.S. Pat. No. 4,938,005.

The web for producing the blanks is conveyed through between an upper knife roller 10 and a counter pressure means arranged thereunder, in particular a counter roller 11. The knife roller 10 and counter roller 11 are rotatably mounted at the sides with axle journals 12, 13 in holding devices, particularly in upright side plates 14, 15. These side plates 14, 15 are mounted at the bottom on a base plate 16.

Knife means, in particular knife edges 17, are arranged on the periphery of the knife roller 10, that is to stay on the shell of the knife roller 10. These knife edges 17 are in the form of ridges which project in the radial direction and are machined from the material of the knife roller 10. The shape of the knife edges 17 corresponds to the contour of the blanks which are to be made, that is to say to the shape of the severing cut. Several of such knife edges 17 are arranged along the periphery of the knife roller 10. Their spacing corresponds to the dimension of one blank in the conveying direction.

Beyond the region of the knife edges 17, particularly at the axial ends of the cylindrical shell surface, the knife roller 10 is provided with annular supporting means for the support of the knife roller 10 on the periphery of the counter roller 11. In the present exemplary embodiment, several parallel annular rims 18 are provided for this a support. These annular rims 18 are separated from one another by annular grooves 19. In the illustrated exemplary embodiment, four of such annular rims 18 are arranged next to one another and are separated by three grooves 19. The grooves 19 have a V-shaped cross section, such that the annular rims 18 have a width of slightly more than 1.5 mm. The annular rims 18 as a whole are delimited from the portion of the knife roller 10 which carries the knife edges 17 by means of a wider separating groove 20.

The axle journals 12, 13 of the knife roller 10 and the counter roller 11 are held in the side plates 14, 15 by means of special bearings. In the present example, each axle journal 12, 13 is mounted with a rolling bearing assembly, such as a ball bearing 21 and a needle bearing 22 arranged next to the ball bearing 21.

Such a bearing 21, 22 of the knife roller 10 is movable in such a way that the knife roller 10 can be pressed against the counter roller 11. For this purpose, the bearing which comprises the ball bearing 21 and the needle bearing 22 is a arranged in a common bearing ring 23 which can be displaced in the vertical direction in a recess 24 of the side plates 14, 15. The recess 24 is in the form of an upright oblong hole. The bearing ring 23 is provided with a projection, particularly with a shoulder 25. This shoulder 25 is guided in a marginal extension 26 of the recess 24 in the side plate 14, 15, such that lateral and axial displacements are avoided.

At the top side, the recess 24 is closed by a separate pressure piece 27 which forms a top part of the side plate 14, 15. This pressure piece 27 is releasably placed on the side plates 14, 15 by means of screws 28.

The ball bearings 21 of the counter roller 11 are directly fitted in an appropriate bore 29 of the side plate 14, 15 to prevent vertical displacement of the counter roller.

The knife roller 10 is pressed against the counter roller 11 by pressure means 30. Each pressure means 30 is arranged in the region of the axle journals 12, 13 or the bearings (ball bearing 21) on the side which is located opposite the counter roller 11. In the present case, the pressure means 30 are located in the pressure piece 27.

Each pressure means 30 comprises an adjusting element which ensures the transfer of an adjustable contact pressure of the knife roller 10 (annular rims 18) against the counter roller 11. In the present case, the pressure means 30 take effect on the bearing ring 23.

The adjusting means is in this case in the form of a setscrew 31 which is mounted within the pressure piece 27 in a correspondingly designed bore 32 with a thread. The setscrew 31 can be operated from the outside with a tool, expediently with a torque spanner. A head 33 of the setscrew 31 which is located within the bore 32 can be engaged with this torque spanner. The torque spanner is set to the a required contact pressure of the knife roller 10 against the counter roller 11.

In the illustrated exemplary embodiment, a resilient flexible pressure is exerted on the knife roller 10 by the s pressure means 30. For this purpose, a plunger 34 with a plunger head 35 is displaceably mounted within a bore of the setscrew 31. A spring means 36 which is biased and rests against the plunger head 35 takes effect on this plunger head 35. The plunger head 35 transfers the resilient pressure created by the spring means 36 to the outer side of the bearing ring 23. In this case, the spring means 36 is in the form of a set of biased cup springs s arranged within a downwardly open recess 37 of the setscrew 31. The free side of the spring means 36 rests against the setscrew 31 within the recess 37. Accordingly, the setscrew 31 varies and determines the tension of the spring means 36.

The contact pressure (against the counter roller 11) which is exerted by the pressure means 30 on the knife roller 10 is set to be slightly higher than the pressure which is required for applying the severing cut. The parts are arranged in such a way that, after the knife edges have started to wear, the knife roller 10 can be readjusted once. For this purpose, the setscrew 31 is operated until the widened head 33 of this screw 31 rests against a stop 38 within the bore 32. In the illustrated embodiment, this stop 38 is formed from a shoulder of the bore 32.

Another outstanding feature is that the knife roller 10 is mounted in a resiliently "floating" manner. For this purpose, a resilient supporting means 39 is arranged in the side plates 14, 15 on the side which is located opposite the pressure means, i.e. directly adjacent the bearing of the counter roller 10. In this case, the supporting means 39 is in the form of a pressure spring (coil spring) located in a central blind hole 40. The bearing ring 23 rests on the supporting means 39, i.e. the pressure spring. The supporting means 39 is biased in such a way that it nearly completely counterbalances the own weight of the knife roller 10, including the parts of the bearing which are moved together with this roller 10. As a result, it is possible to press the knife roller 10 against the counter roller 11 with the pressure means 30 without the effect of this weight.

Figure 5:
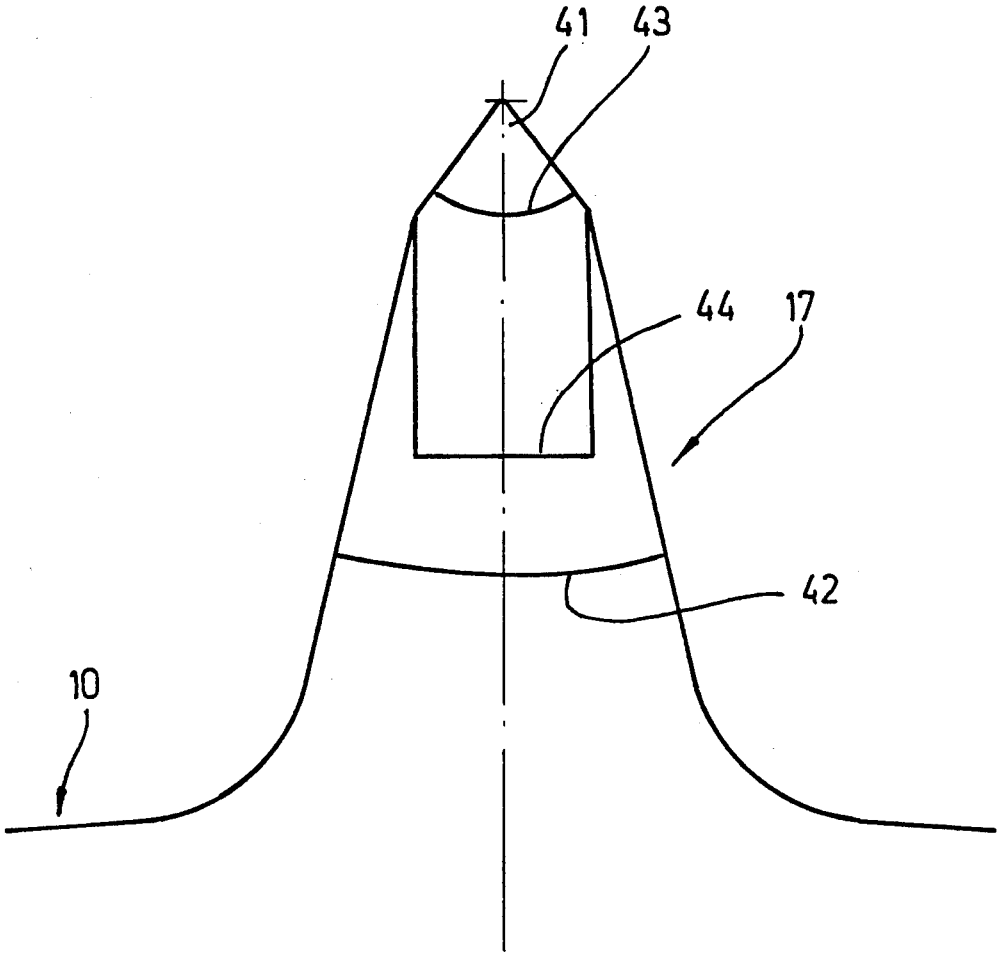
FIG. 5 shows a cross section of a knife edge of the knife roller, on a greatly enlarged scale.

Another outstanding feature of the illustrated exemplary embodiment is the cross-sectional shape of the knife edges 17. As is evident from FIG. 5, these knife edges 17 converge from the shell surface of the knife roller 10 towards the free edge or cutting edge 41 of the knife edges 17. The angle 42 of the flanks of the knife edges 17 is approximately 26°. In the radially outer region of the knife edge 17, the flanks bend and the profile tapers even more. The angle 43 which delimits the flanks is 72°. In the present embodiment, the distance 44 between the side faces at the point of transition to this greater convergence of the flanks, which convergence forms the actual cutting edge 41, is approximately 0.74 mm. The outer marginal region of the knife edge 17 is formed by being rounded with a wire brush or the like. The dimension of the knife edge 17 in the radial direction, i.e. the projection of the knife edge beyond the shell surface of the knife roller 10 is approximately 6 mm.

Further outstanding features of the exemplary embodiment relate to the continuous cleaning of the cutting device. In the region of the lateral rims or annular rims 18, there is a stationary scraper 45 (schematically illustrated in FIG. 1) which continuously removes deposits from the outer faces of the annular rims 18 while they rotate.

A crosspiece 46 which extends from one side plate 14 to the other side plate 15 carries a cleaning means for the knife roller, that is to say for its knife edges 17. The cleaning means is preferably in the form of a brush (not shown) and the knife edges 17 are moved past this brush.

The counter roller 11 is also continuously cleaned. For this purpose, there is provided a carrying profile 47 which also extends from one side plate 14 to the other side plate 15 and which comprises a suitable cleaning means for the smooth-surfaced counter roller 11, especially a strip of felt.

Moreover, the counter roller 11 is associated with a cleaning means in the form of a stationary plate 48 (FIG. 4) for removing trailing and leading pieces of the web for producing the blanks. These pieces of material are lifted off the shell of the counter roller 11 by the sharpened plate 48 and are ejected.

Figure 4:
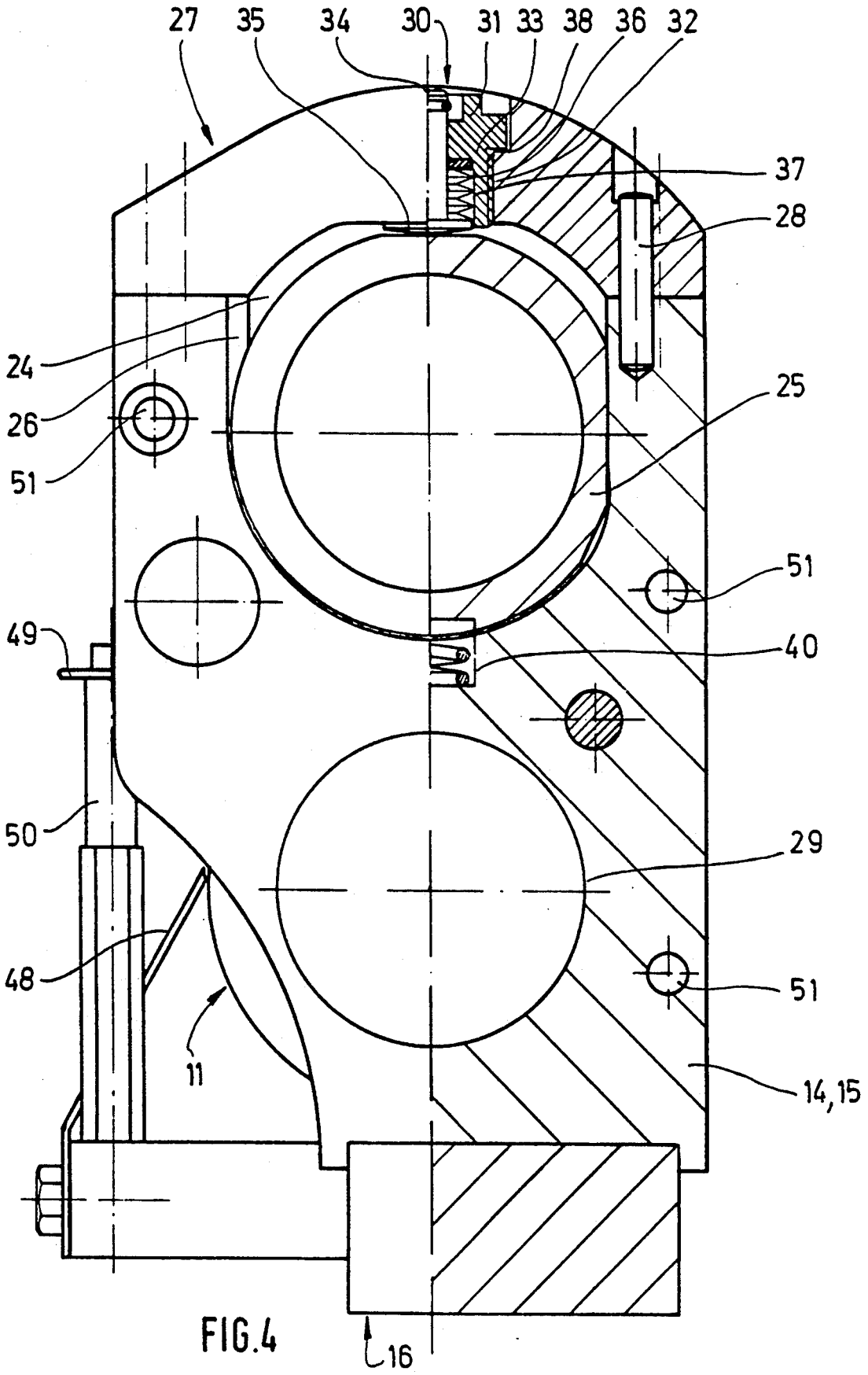
FIG. 4 shows an axially directed side view of the apparatus, partly in vertical section.

FIG. 4 also illustrates a short table board 49 which is approximately located in the plane of the passage of the web between knife roller 10 and counter roller 11. The table board 49 serves for receiving the severed blanks for a short while until they are discharged. The table board 49 is attached to a stay bolt 50.

To improve the stability of the support structure, the two side plates 14, 15 are connected to one another and are therewith supported against one another by cross bars 51.

Figure 3:
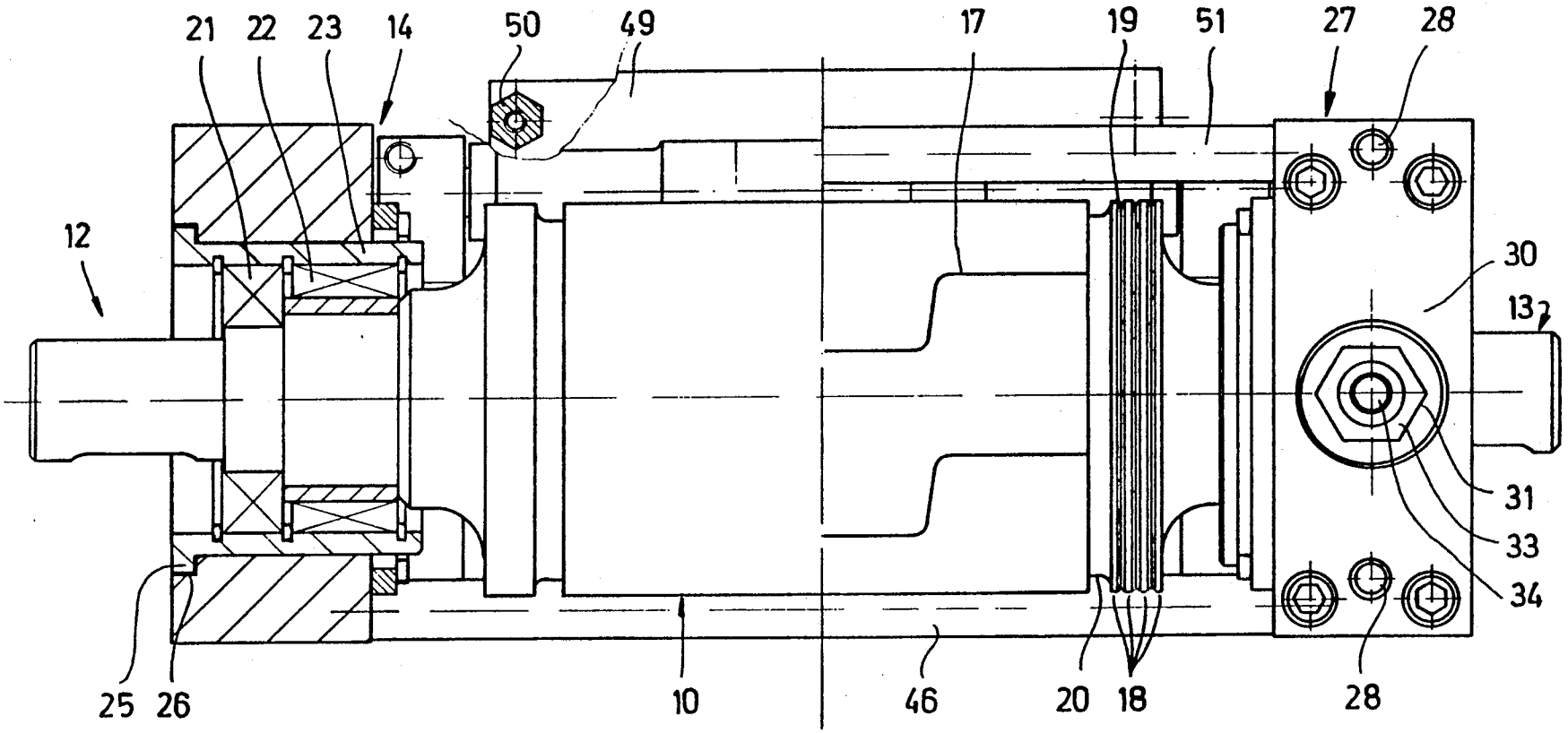
FIG. 3 is a plan view of the apparatus of FIG. 1, particularly of the knife roller.
Figure 7:
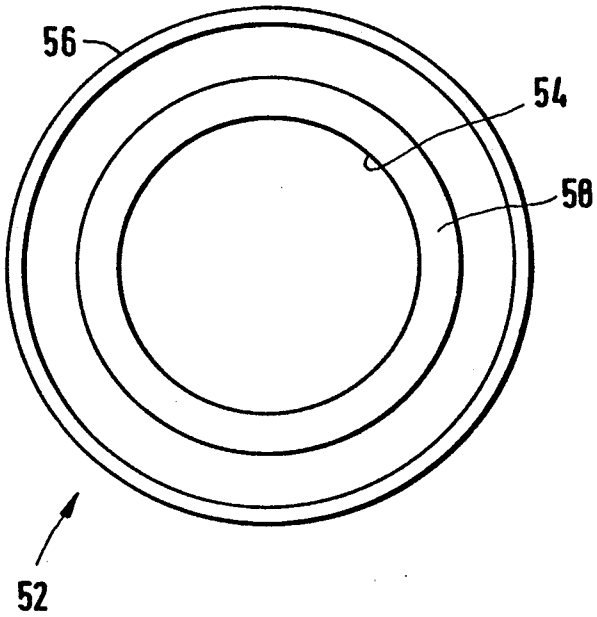
FIG. 7 shows a view of the ring with a profile according to FIG. 6.
Figure 6:
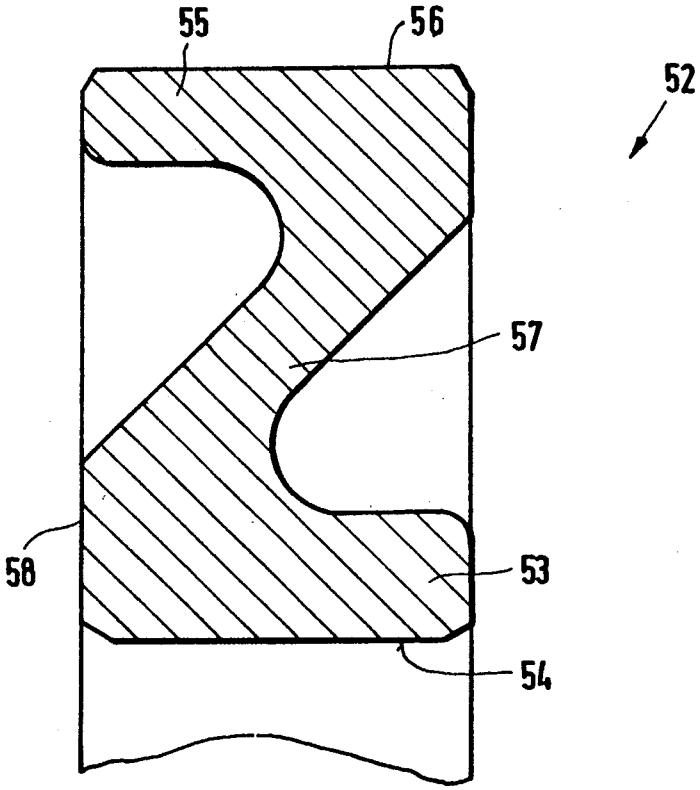
FIG. 6 shows a cross section of a supporting ring (annular rim) of the knife roller, on a greatly enlarged scale.

A particularly expedient embodiment of the annular rims 18 of the knife roller 10 is illustrated in FIG. 6 and FIG. 7. A separate ring 52 with a profile which can be slightly compressed in the radial direction under an appropriate pressure is placed on the axle journals 12 and 13 of the knife roller 10 adjacent the shell of the knife roller 10, particularly in the location of the annular rims 18 as illustrated by way of example in FIG. 3. Preferably, the annular rim 18 which is formed by the ring 52 has a Z-shaped cross section as illustrated in FIG. 6. An inner leg 53 serves for contacting a hub of the axle journal 12, 13. A cylindrical contact surface 54 is rigidly connected to the axle journal 12, 13 or the hub in a suitable manner.

An outer leg 55 which extends parallel to and at a radial distance from the inner leg forms an outer cylindrical supporting surface 56 for contacting the counter roller 11 or a rim of this roller 11. Between the two legs 53, 55 there extends a profile which as a result of the design and/or dimension ensures the resilient compressibility of the ring 52 in the radial direction. In the exemplary embodiment described above, an inclined or diagonally directed connecting web 57 with a smaller transverse dimension is provided, so that, altogether, a Z-profile with rounded inner corners is formed.

In each case, the profile is arranged on the axle journals 12, 13 in such a way that the radially inward and laterally greater contact surface 58 is directed towards the shell surface of the knife roller 10 and, in this case, rests against a shoulder. Accordingly, the ring 52 which is illustrated in FIG. 6 is assigned to the right hand side of the knife roller 10 with respect to FIG. 3.

We claim:

1. In an apparatus for severing collar blanks of a hinge lid pack from a web of material, said apparatus comprising: a rotatable knife roller (10) having a rotational axis and having severing knife edges (17) in a region of an outer periphery thereof; a likewise rotatable counter roller (11) having an outer periphery and acting as a counter means for the knife roller (10); and adjustable pressure means for pressing said knife roller (10) against the counter roller (11) with a contact pressure; the improvement wherein:

a) the outer periphery of the knife roller (10) comprises a cylindrical shell surface;

b) outside the region of the knife edges (17), the knife roller (10) has, at an axial end of the cylindrical shell surface, a plurality of parallel annular supporting means for supporting the knife roller on the periphery of the counter roller (11);

c) said supporting means comprise parallel annular rims (18) having annular grooves (19) formed therebetween; and d) said adjustable pressure means exert sufficient contact pressure of the knife roller (10) on the counter roller (11) to cause the annular rims (18) to be slightly radially compressible in a resilient manner.

2. The apparatus as claimed in claim 1, wherein said annular rims (18) comprise a ring (52) on a hub of the knife roller (10); wherein said ring has an outer annular supporting profile (55) and an inner contact profile (53) which are radially spaced apart; and wherein said ring has a resiliently deformable intermediate profile (57) arranged between said supporting profile and said contact profile.

3. The apparatus as claimed in claim 2, wherein said ring (52) has a cross-sectionally Z-shaped profile with a radially outer cylindrical supporting surface (56).

4. The apparatus as claimed in claim 2, wherein the pressure means (30) exert a contact pressure which is slightly greater than that required for severing the web of material.

5. The apparatus as claimed in claim 3 or 4, wherein each pressure means (30) has a set screw (31) which adjusts the resilient contact pressure, and which is movable against a stop (38) to create a maximum contact pressure exerted by the pressure means (30).

6. The apparatus as claimed in claim 5, wherein each of said pressure means comprises adjustable-tension spring means (36).

7. The apparatus as claimed in claim 6, wherein said spring means (36) comprises a plurality of biased cup springs.

8. The apparatus as claimed in claim 1, wherein the knife roller (10) is associated with a fixed cleaning means in the form of brushes which are arranged on a transversely directed carrying means in the form of a crosspiece (46).

9. The apparatus as claimed in claim 1, wherein the counter roller 911) is associated with a cleaning means in the form of a strip of felt which is arranged on a carrying profile (47).

* * * * *